US005140875A

United States Patent [19]

Kim

[11] Patent Number: 5,140,875

[45] Date of Patent: Aug. 25, 1992

[54] SOCKET WRENCH

[76] Inventor: Kwang M. Kim, 387-13 Ahcheon-Dong, Koori, Kyunggi-Do, Rep. of Korea

[21] Appl. No.: 578,578

[22] Filed: Sep. 7, 1990

[30] Foreign Application Priority Data

Jul. 21, 1990 [KR] Rep. of Korea ..... 90-10723

[51] Int. Cl.[5] ..... B25B 13/46

[52] U.S. Cl. ..... 81/63.1; 81/124.4

[58] Field of Search ..... 81/60, 62, 63.1, 185, 81/124.4, DIG. 11

[56] References Cited

U.S. PATENT DOCUMENTS 2,711,112 6/1955 Durand ..... 81/185

4,528,875 7/1985 Hurst et al. ..... 81/185

4,840,094 6/1989 Macor ..... 81/185

*Primary Examiner*—James G. Smith

*Attorney, Agent, or Firm*—Birch, Stewart, Kolasch & Birch

[57] ABSTRACT

A socket wrench which includes a main body having a handle, a main socket member having a main outer socket and a plurality of main socket units coupled with the main body, an auxiliary socket member having an auxiliary outer socket and a plurality of auxiliary socket units and coupled with the main socket member, and ratchet member having a pair of ratchets for setting the revolution direction of the main socket member, whereby the socket wrench can easily handle various size bolts and nuts.

10 Claims, 5 Drawing Sheets

SOCKET WRENCH

BACKGROUND OF THE INVENTION

1. Field of the Invention

The present invention relates to an improved socket wrench, and more particularly, to a socket wrench comprising a main socket member and an auxiliary socket member removably assembled with the main socket member wherein the main and auxiliary socket members have a plurality of socket units of different sizes, respectively, so that, when various size bolts or nuts are loosened or tightened, both socket members can be assembled or disassembled according to the size of the bolt or nut so as to easily handle the bolts or nuts.

2. Description of the Prior Art

Various types of socket wrenches are well known in the art which utilize a ratchet handle and various size sockets engaged to the ratchet handle. However, these wrenches suffer from a number of difficulties such as, for example, it is very difficult to select a socket which properly mates with the object to which it is applied. Also the sockets can be readily lost and are expensive to manufacture. Furthermore, in specific wrenches, such as monkey spanners, the thumb must be utilized to push a lever against the bias of a worm gear to permit the jaws of the monkey spanners to close around the desired object.

In order to solve such problems, the present inventor is prosecuting another U.S. Pat. application Ser. No. 07/550,369, filed July 10, 1990, now allowed, which discloses a socket wrench which comprises a plurality of socket members having different diameters for movably fitting into the interior of a main body, adjusting members for the socket members, and a ratchet member for setting the revolving direction of the socket members so that the proper socket member of them can be selected and utilized without changing the socket member. However, this socket wrench has a disadvantage that the various size socket members cannot meet the requirements of the various sizes of existing bolts and nuts since the socket members cannot be manufactured in a certain thickness below no matter what kind of material is used.

SUMMARY OF THE INVENTION

Accordingly, it is an object of the present invention to provide a socket wrench for handling a desired object such as, for example, various size bolts and nuts which is simple in construction, inexpensive to manufacture, and durable in use.

Another object of the present invention is to provide a socket wrench which comprises a main socket member installed within a main body and including a plurality of main socket units having different diameters, and an auxiliary socket member installed detachably from the main body and including a plurality of auxiliary socket units having intermediate sizes between the sizes of the main socket units and at least one auxiliary outer socket, whereby the socket wrench can satisfy any standardized sizes of the bolts and nuts.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a socket wrench which includes a main body having a handle, a main socket member having a main outer socket and a plurality of main socket units coupled with the main body, an auxiliary socket member having an auxiliary outer socket a plurality of auxiliary socket units and coupled with the main socket member, respectively, and ratchet member having a pair of ratchets for setting the revolution direction of the main socket member, whereby the socket wrench can easily handle various size bolts and nuts.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
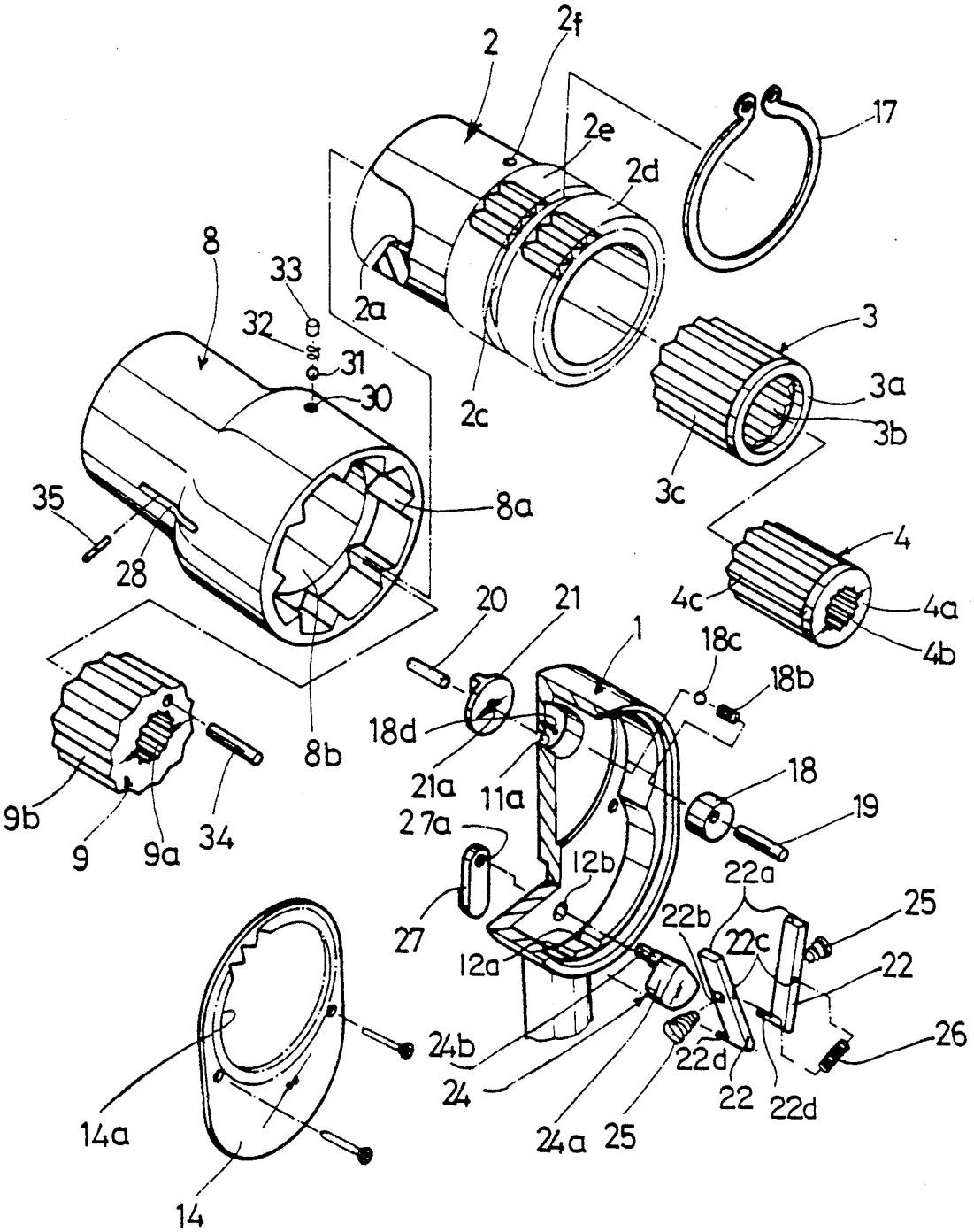
FIG. 1 is an exploded perspective view of the socket wrench according to the present invention.

Referring now in detail to the drawings for the purpose of illustrating preferred embodiments of the present invention, the socket wrench as shown in FIGS. 1 to 4, comprises a main body 1 having a handle 1*a*, a main socket member 5 having a main outer socket 2 and a plurality main socket units 3 and 4 inserted into the main outer socket 2, an adjusting member 6 for adjusting the axial actuation of the main socket units 3 and 4, a ratchet member 7 for setting the revolution direction of the main socket member 5, and an auxiliary socket member 10 coupled with the outer circumferential surface of the main socket member 5 and having an auxiliary outer socket 8 and an auxiliary socket unit 9. The auxiliary socket member 10 can contain a plurality of main and auxiliary socket units 3, 4, and 9.

The main body 1 is provided with a recess 11 for accommodating the main socket member 5, an outer seat portion 13 and a hollow portion 12 for installing the ratchet member 7, and an inner recess 15 for securing a main socket cover 14. The recess 11 is provided with an installing hole 11*a* for securing the adjusting member 6 while the hollow portion 12 is provided with coupling slots 12*a* for securing the ratchet member 7, and an installing hole 12*b* for installing an adjusting knob 27.

The main socket member 5 includes the main outer socket 2 for accommodating plurality of the main socket units 3 and 4 in such a manner that the main socket units 3 and 4 are slidably inserted into the main outer socket 2 in the axial direction. The main socket units 3 and 4 are integrally provided with flange portions 3*a* and 4*a*, respectively, while the outer and inner circumferential surfaces of the main socket units 3 and 4 are provided with teeth portions 3*b*, 3*c*, 4*b*, and 4*c*, in such a manner that the main socket units 3 and 4 can be concentrically coupled with each other.

The main outer socket 2 includes a teeth portion 2*a* and an annular step 2*b* disposed on the inside thereof, and a securing slot 2*f* and teeth portions 2*d* and 2*e* divided by an annular groove 2*c* disposed on the outside thereof. The flange portion 3*a* of the main socket unit 3 is stopped at the annular step 2*b* of the main outer socket 2 while the main socket cover 14 having a snap ring 17 and a teeth shaped opening 14*a* is installed by securing to the annular groove 2*c*.

Figure 2:
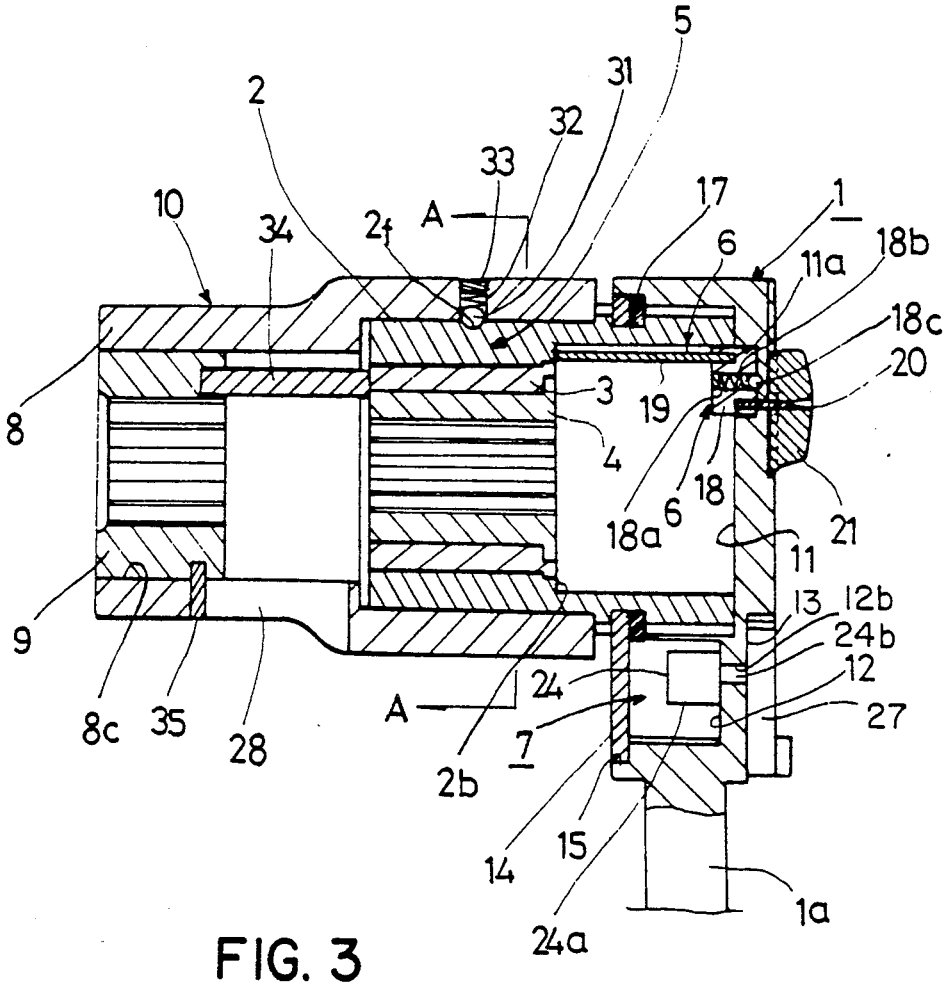
FIG. 2 is a sectional view of the socket wrench according to the present invention.
Figure 3:
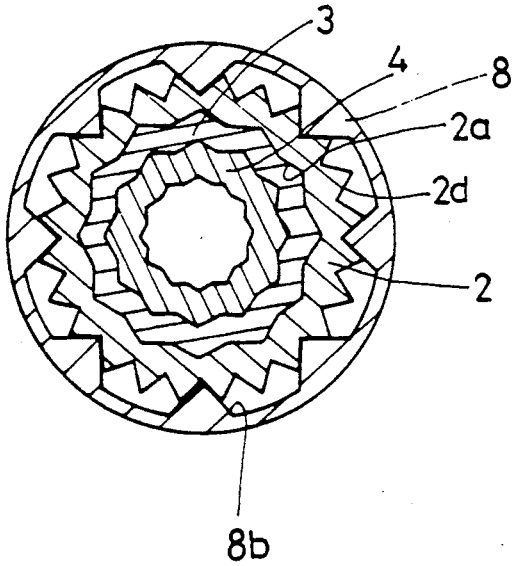
FIG. 3 is a cross-sectional view of FIG. 2, taken along line A—A.

The adjusting member 6 includes an actuation bar 19 fitted to one side of the lower portion of a connecting member 18, a connecting shaft 20 secured to one side of the upper portion of the connecting member 18, and an adjusting knob 21 secured to the connecting shaft 20. At the center of the top of the connecting member 18, there is formed a slot 18*a* for receiving a spring 18*b* and a securing ball 18*c*. The adjusting member 6 is assembled in such a manner that, in the actuation bar 19, the connecting shaft 20, the spring 18*b*, and the securing ball 18*c* coupled together with the connecting shaft 20 is inserted into the installing hole 11*a*, and then the adjusting knob 21 is securely fitted into a lower coupling hole 21*a*. Thus, when the adjusting knob 21 rotates, the connecting shaft 20, the connecting member 18 and the actuation bar 19 rotate in an interlocked state with one another. The adjusting knob 21 has only to be rotated around the connecting shaft 20 in accordance with the contact position between the actuation bar 19 and the annular step 2*b* of the main outer socket 2 or between the actuation bar 19 and the upper faces of the main socket units 3 and 4. As shown in FIGS 1 and 2, securing ball 18*c* and the actuation bar 19 are rotated around the connecting shaft 20 so as for the ball 18*c* to be coupled with either one of the ball securing slots 18*d* of the main body 1 and the actuation bar 19 to be positioned either on the annular step 2*b* of the main outer socket 2 or on the upper faces of the main socket units 3 and 4, thereby deciding the lifting of the main socket units 3 and 4.

The ratchet member 7 is provided with a pair of ratchets 22 fitted to the coupling slots 12*a* of the main body 1, respectively, and a pressing cam 24 rotatively inserted into the installing hole 12*b* and fixedly secured to the adjusting knob 27. Each of the pair of ratchets 22 includes an engaging portion 22*a* geared with the upper teeth portion 2*d* of the main outer socket 2, a spring installing slot 22*b*, a spring hooking hole 22*c*, and an integral pivoting shaft 22*d*.

The spring installing slot 22*b* receives a compression spring 25 and the spring hooking hole 22*c* receives one end of a tension spring 26 so that the pair of ratchets 22 are elastically supported each other.

The pressing cam 24 contains a cam-shaped pressing tip 24*a* and an upper pivoting shaft 24*b*. The adjusting knob 27 is provided with an installing hole 27*a* so that, upon coupling with each other, the pivoting shaft 24*b* can be inserted into the installing hole 12*b* in a rotation manner, and that it can also be inserted into the installing hole 27*a* of the adjusting knob 27 to be fixedly fitted therein. Thus the pressing cam 24 is interlocked with the revolution of the adjusting knob 27. When the pressing tip 24*a* presses any one of the ratchets 22, the engaging portion 22*a* of the ratchets 22 which is not pressed is geared with the upper teeth portion 2*d* of the main outer socket 2, thereby deciding the rotating direction of the main outer socket 2.

The auxiliary socket member 10 includes an auxiliary outer socket 8 having an elongated slot 28 disposed in the longitudinal direction thereof, an upper teeth portion 8*a* disposed on an entrance portion of the inside of the auxiliary outer socket 8, a lower teeth portion 8*c* formed on the lower inside portion of the auxiliary outer socket 8, and an intermediate portion 8*b* disposed between the upper teeth portion 8*a* and the lower teeth portion 8*c*. Into the lower teeth portion 8*c*, there is inserted the auxiliary socket unit 9 having outer and inner teeth portions 9*a* and 9*b*. The auxiliary socket unit 9 is different diameter thereof from that of the main socket units 3 and 4 for handling bolts and nuts having various diameters.

A threaded hole 30 is formed on the intermediate portion 8*b* for receiving a securing ball 31, a supporting spring 32, and a headless bolt 33 so that, upon coupling the main and auxiliary socket members 5 and 10, the upper teeth portion 8*a* is fitted and coupled with the lower teeth portion 2*e* of the main outer socket 2. The securing ball 31 secured to the spring 32 is inserted into the securing slot 2*f* thereby securely coupling with the main and auxiliary socket members 5 and 10.

An adjusting pin 34 is secured to one side of the auxiliary socket unit 9 and a securing pin 35 is fitted to another side of the auxiliary socket unit 9 so as for the pin 35 to be fitted to the elongated slot 28. Thus when the main socket units 3 and 4 of the main socket member 5 rise upwardly, the auxiliary socket unit 9 can rise upwardly while the securing pin 35 can move up and down only within the elongated slot 28 which is formed on the auxiliary outer socket 8.

Figures 5, 6A, 6B:
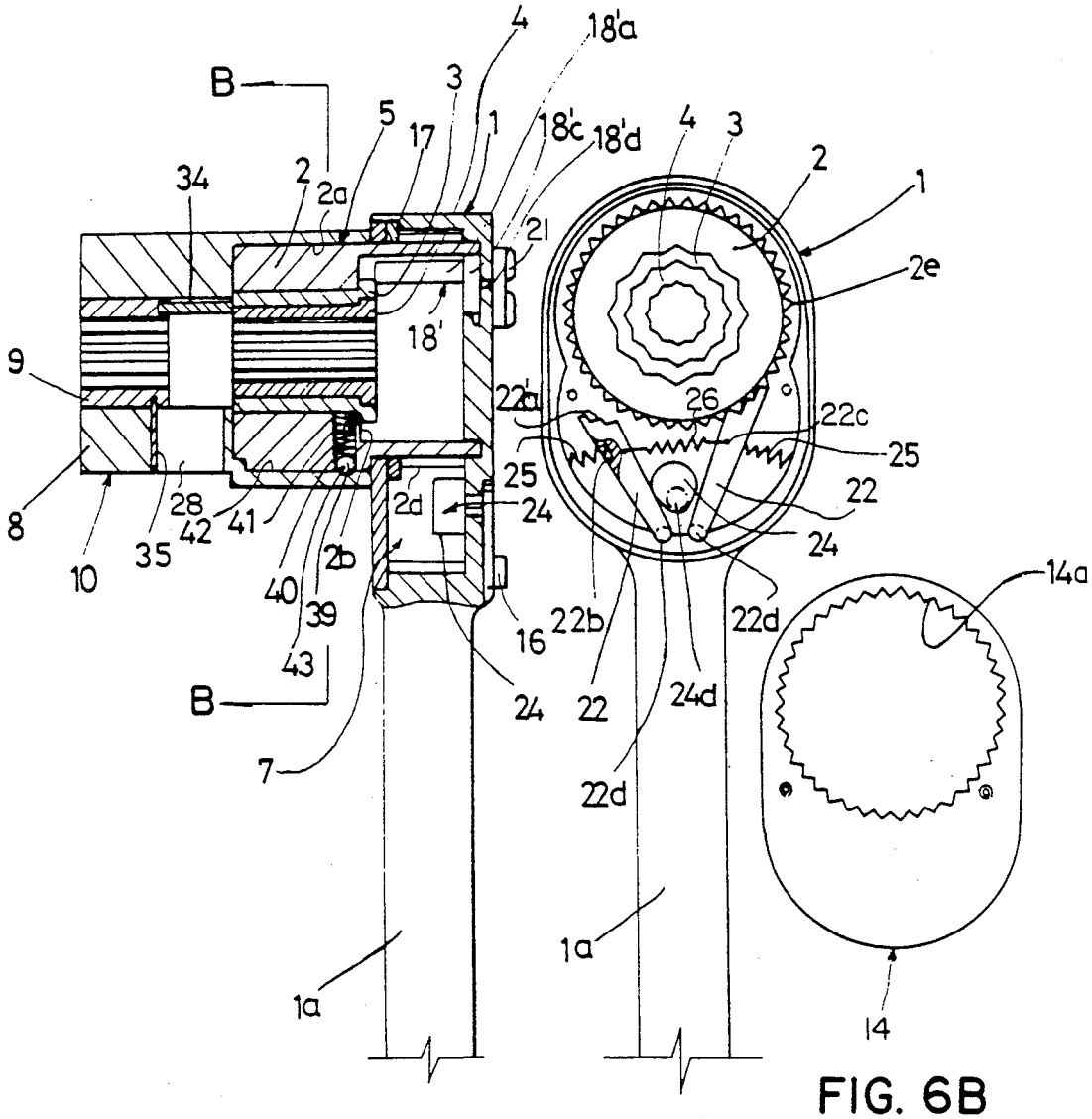
FIG. 5 is a sectional view of another embodiment of the socket wrench according to the present invention.
FIG. 6*a* is a top plan view of FIG. 5 showing a state with the separated main socket cover and without socket member.
Figure 7:
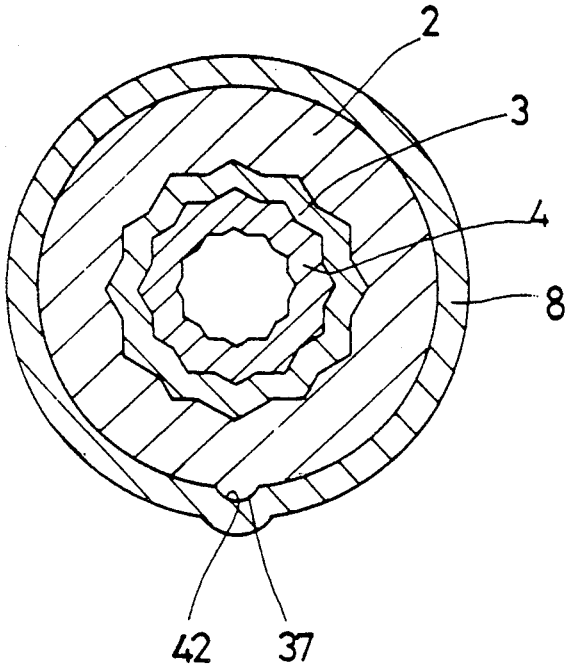
FIG. 7 is a cross-sectional view of FIG. 5, taken along line B—B.

FIGS. 5 to 7 illustrate another embodiment of the present invention. When compared with the first embodiment of the present invention, the main body 1 and the main socket units 3 and 4, and the auxiliary socket unit 9 are same in their constitutions also in the second embodiment of the present invention. However, the main outer socket 2 of the main socket member 5, the auxiliary outer socket 8 of the auxiliary socket member 10, the adjusting member 6, and the ratchet member 7 are slightly different from that of the first embodiment of the present invention.

The modified feature of the second embodiment of the present invention is as described below. The main outer socket 2 of the main socket member 5 is provided with the annular step 2*b* and the teeth portion 2*a* disposed on the inside thereof, and the teeth portion 2*d* and longitudinal projection 37 disposed the outside thereof. Furthermore, the main socket 2 is provided with a threaded hole 38 for receiving a securing ball 39, a supporting spring 40, and a headless bolt 41.

The auxiliary outer socket 8 of the auxiliary socket member 10 is provided with a longitudinal groove 42 disposed on the inner circumferential surface thereof so as for the longitudinal projection 37 to be coupled with the longitudinal groove 42. And a securing slot 43 is disposed on one side of the longitudinal groove 42 so that the ball 39 can be inserted into the securing slot 43.

The adjusting member 6 includes a combination of an actuation bar 18' and an adjusting knob 21, and the actuation bar 18' is provided with an adjusting bar 18*a* having an elliptical cross section, a disc shaped portion 18*c*, and an upper central shaft 18*d* in an integral form.

When compared with the ratchet member 7 of the first embodiment of the present invention, the spring installing slot 22*b*, the spring hooking hole 22*c*, the integral pivoting shaft 22*d* of the pair of ratchets 22, the adjusting knob 27, the pressing cam 24, the compression spring 25, and the tension spring 26 are same in their constitutions also in the second embodiment of the present invention. However, the engaging portion 22*a* is different from that of the first embodiment of the present invention. Each of the pair of ratchets 22 includes a three step engaging portion 22'*a* for gearing with the upper teeth portion 2*d* of the main outer socket 2. Thus the pressing cam 24 is interlocked with the revolution of the adjusting knob 27. When the pressing tip 24*a* presses any one of the pair of ratchets 22 which is not pressed is geared with the upper teeth portion 2*d* of the outer socket 2 thereby deciding the rotating direction of the main outer socket 2.

The socket wrench of the present invention operates as follows: Both socket wrench as illustrated in FIGS. 1 and 5 are same each other in the operating method thereof and accordingly, the socket wrench of FIGS. 1 to 4 of the first embodiment of the present invention will now be described as follows:

The use of the socket wrench of the present invention can be broken down into two steps. The first one is the step in which only the main socket member 5 coupled with the main body 1 is used while the second one is the step in which the auxiliary socket member 10 is used wherein the auxiliary socket member 10 is combined with the main socket member 5 and the main body 1.

Figure 4A:
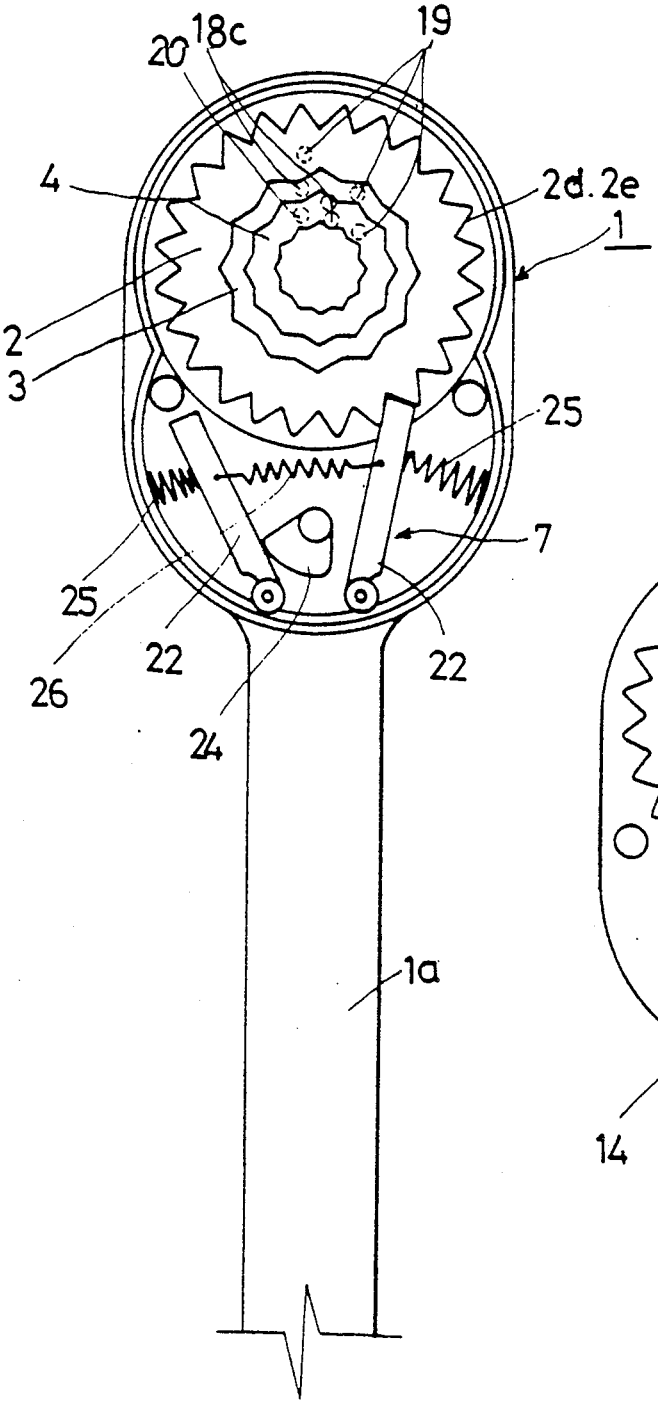
FIG. 4*a* is a top plan view of the socket wrench according to the present invention showing a state with a separated main socket cover and without an auxiliary socket member.
Figure 4B:
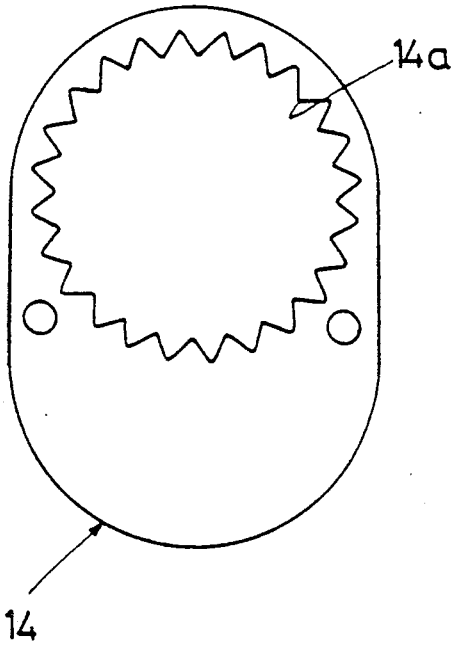
FIGS. 4*b* and 6*b* show the main socket cover.

A proper one which is fitted to the bolt or nut is selected from among the main outer socket 2 and the main socket units 3 and 4 and an adjustment is made by turning the adjusting knob 21 of the adjusting member 6. That as shown in FIG. 4 is, the adjustment is made in such a manner that, when the adjusting knob 21 is turned, depending on the contact position disposed between the actuation bar 19 on the one hand and the annular step 2*b* of the main outer socket 2 and the flange portions 3*a* and 4*a* of the main socket units 3 and 4 on the other hand, the irrelevant socket units 3 and 4 are withdrawn or lifted, the relevant one fitted to the bolt or nut is remained to perform operation.

Furthermore, depending on the loosening or tightening of the bolt or nut, the adjusting knob 27 is rotated to the left or right to provide the desired function to the main outer socket 2 or the main socket units 3 and 4. Under this condition, one of the ratchets 22 can maintain strong supporting forces owing to the compression spring 25 and the tension spring 26 and it can form a firm coupling with the upper teeth portion 2*d* due to the engaging portion 22*a*.

Meanwhile, in the step of the latter in which the auxiliary socket member 10 is used in a state coupled with the main socket member 5 and the main body 1 and the auxiliary socket 10 is used for bolts and nuts which are not fitted to the main outer socket 2 and the main socket units 3 and 4 of the main socket member 5.

For example, in the case of a bolt or nut which has a size intermediate between the main socket unit 3 and the main socket unit 4, the auxiliary socket unit 9 can be used while, in the case of a bolt or a nut having a size larger than that of the main outer socket 2, the auxiliary outer socket 8 can be used. In the case which the auxiliary socket unit 9 is used, the actuation bar 19 is let to be positioned on the main socket units 3 and 4 by turning the adjusting knob 21 so as for the main socket unit 3 not to be withdrawn and so as for the auxiliary socket unit 9 not to be withdrawn by the function of the pin 34 after the auxiliary socket unit 9 is fixed to the socket member 10.

In the case which the auxiliary outer socket 8 is to be use, the actuation bar 19 is let to be positioned on the annular step 2*b* of the main outer socket 2 by turning the adjusting knob 21 so that the main socket unit 3 can be lifted or withdrawn. The auxiliary socket unit 9 is pushed up together with the pin 34 and the securing pin 35 is let to be lifted along the elongated slot 28.

Thus one relevant socket among main and auxiliary outer sockets 2 and 8, and main and auxiliary socket units 3, 4, and 9 is selected for the bolt or nut to be tightened or loosened, and the lower and upper socket members 5 and 10 are attached or detached if necessary.

According to the present invention as described above, the main and auxiliary outer sockets 2 and 8 and the main and auxiliary socket units 3, 4, and 9 of the main and auxiliary socket members 5 and 10 can be arbitrarily attached or detached depending on the need in a simple manner so that the socket wrench of the present invention can be used for different sizes of bolts and nuts. Particularly, the ratchet member 7 includes the pair of ratchets 22 including the three step engaging portion 22'*a*, the compression spring 25, and the tension spring 26 so that the operation of ratchet member 7 is exact and perfect. Thus the socket wrench of the present invention is relatively simple in construction, inexpensive to manufacture and easy in use thereby using it as a practical tool.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A socket wrench comprising:

a main body having a handle, a main socket member coupled with said main body, said main socket member including a main outer socket and a plurality of main socket units, an adjusting member for adjusting the axial actuation of said main socket units, a ratchet member for setting the revolution direction of said main socket member, and an auxiliary socket member assembled with said main socket member, said auxiliary socket member including an auxiliary outer socket and a plurality of auxiliary socket units, whereby the socket wrench can be easily handled various size bolts and nuts.

2. The socket wrench of claim 1, wherein the main outer socket includes upper and lower portions, an annular groove for coupling with a main socket cover which has a snap ring and a teeth shaped opening, and a securing slot.

3. The socket wrench of claim 1, wherein the adjusting member includes an actuation bar secured to one side of the lower portion of a connecting member, a connecting shaft secured to one side of the upper portion of said connecting member, an adjusting knob secured to said connecting shaft, and a spring and a securing ball inserted into a slot which is disposed at the center of the top of the said connecting member.

4. The socket wrench of claim 1, wherein the ratchet member includes a pair of ratchets having an engaging portion, said engaging portion geared with said upper teeth portion, a spring installing slot for accommodating a compression spring for receiving a tension spring, respectively.

5. The socket wrench of claim 1, wherein the auxiliary outer socket includes an elongated slot disposed in the longitudinal direction thereon, an upper teeth portion formed on the inside thereof, a lower teeth portion and an intermediate portion formed between said upper teeth portion and said lower teeth portion.

6. The socket wrench of claim 1, wherein the auxiliary socket unit has a different size from the sizes of said main socket units and is coupled with said lower teeth portion, said auxiliary socket unit provided with an aperture for receiving an adjusting pin and an elongated slot for receiving a securing pin.

7. The socket wrench of claim 5, wherein intermediate portion has a threaded hole for accommodating a ball, a supporting spring, and a headless bolt so as for said ball to be fitted into said securing slot when said main and auxiliary socket members are assembled with each other.

8. The socket wrench of claim 2, wherein the main outer socket includes a teeth portion disposed on the outside thereof, a longitudinal projection disposed on the outside thereof, and a threaded hole formed on said main outer socket for accommodating a securing ball, a supporting spring, and a headless bolt.

9. The socket wrench of claim 4, the ratchet member includes a pair of three step engaging portions for gearing with said upper teeth portion of said main outer socket of said main upper socket member.

10. The socket wrench of claim 1, wherein the auxiliary outer socket includes a longitudinal groove for coupling with said longitudinal projection, said longitudinal groove having a securing slot for receiving said ball when said main and auxiliary socket members are coupled with each other.

* * * * *